US005351992A

United States Patent [19]

Chilson et al.

[11] Patent Number: 5,351,992

[45] Date of Patent: Oct. 4, 1994

[54] ITINERARY PLANNER

[76] Inventors: Douglas Chilson; Pamela Chilson, both of 2245 Wisconsin SW., Huron, S. Dak. 57350

[21] Appl. No.: 194,505

[22] Filed: Feb. 9, 1994

[51] Int. Cl.[5] ..... B42D 3/00

[52] U.S. Cl. ..... 281/31; 281/30

[58] Field of Search ..... 281/15, 18, 29, 30, 281/31; 206/232; 402/80 R; 40/159.1, 661, 904

[56] References Cited

U.S. PATENT DOCUMENTS

| | | | |
|---|---|---|---|
| D. 312,278 | 11/1990 | Moor . | |
| 2,791,040 | 5/1957 | Santorelli . | |
| 3,870,223 | 3/1975 | Wyant | 281/31 |
| 4,296,945 | 10/1981 | Pavlik | 281/31 |
| 4,832,369 | 5/1989 | Johnson et al. | 281/18 |
| 4,838,724 | 6/1989 | Spence, Jr. | 402/79 |
| 4,890,728 | 1/1990 | Grimsley | 281/30 |
| 4,932,520 | 6/1990 | Ciarcia et al. | 281/30 |
| 5,007,192 | 4/1991 | Hochberg | 40/661 |
| 5,029,899 | 7/1991 | Schieppati et al. | 281/30 |
| 5,059,052 | 10/1991 | Casper | 281/31 |
| 5,114,009 | 5/1992 | Johnston | 206/425 |
| 5,236,226 | 8/1993 | Sheffield | 287/48 |

FOREIGN PATENT DOCUMENTS

| | | | |
|---|---|---|---|
| 2316063 | 10/1974 | Fed. Rep. of Germany | 281/31 |

*Primary Examiner*—Richard K. Seidel

*Assistant Examiner*—Hwei-Siu Payer

*Attorney, Agent, or Firm*—Richard C. Litman

[57] ABSTRACT

A portfolio of the notebook binder type, for holding and displaying a map, an index associated with the map, a writing pad, and writing implements. The portfolio has a front rigid cover including a pocket and a spring clip both located on the inner face. The pocket accepts the stiff backboard of a writing pad. The spring clip is used to retain the pad in the pocket. There is also a rigid rear cover having a pocket having a transparent inner face or a window, for retaining and revealing a map. A hinge pivotally attaches the front and rear covers, and includes hook and loop material for holding at least one writing implement on the inside surface of the hinge. The rear cover has a pivotally or hingedly attached flap of reduced width. The flap has a pocket for holding and displaying an index corresponding to the map, and has hook and loop material for holding the portfolio in the folded condition. The map, index, and writing pad are readily removable from the portfolio. The transparent faces or windows enable an ink marker or the like to be used to enter notes on the map or index, and to be readily erased, as by wiping. A preferred application of the novel portfolio is to enable a person, such as a shopper, to organize a local itinerary within a town or neighborhood, entering notes pertaining to selected stops or locations, while visually encompassing the entire itinerary.

8 Claims, 4 Drawing Sheets

ITINERARY PLANNER

BACKGROUND OF THE INVENTION

1. Field of the Invention

The present invention relates to a portfolio or folding cover for displaying a map, an index or directory for the map, and for holding a writing pad and writing implements.

2. Description of the Prior Art

Apparatus for storing and utilizing reading and writing materials are well known in the art. In particular, those materials which are frequently consulted during travel, and which enable temporary notes to be recorded and readily available, have been the attention of many attempts to provide suitable binders, portfolios, and like apparatuses.

The following inventions exemplify different aspects appearing in an ongoing attempt to provide a satisfactory information displaying and recording aid.

U.S. Pat. No. 5,007,192, issued to Nelson Hochberg on Apr. 16, 1991, discloses a lapboard intended for holding a map to enable navigation. The lapboard includes a transparent sheet for covering a map or similar navigational aid. The clear sheet can be written on, as for temporary notations. These notations can later be erased by wiping off the clear sheet. Spring clips are provided on outer edges of the main sheets or panels, for securing maps and other sheet materials thereto.

A waiter's order organizer wallet is seen in U.S. Pat. No. 4,932,520, issued to Michael J. Ciarcia et al. on Jun. 12, 1990. This wallet folds along a central fold line, there being a writing implement removably secured within the wallet, along the fold line. One of the two sides of the wallet is slotted to accept the backing board of a pad of writing paper.

A portfolio binder having outer covers secured together by mating patches of hook and loop material is seen in U.S. Pat. No. 5,236,226, issued to Cheryl A. Sheffield on Aug. 17, 1993. A clipboard having similar cover securement is shown in U.S. Pat. No. 4,832,369, issued to Gary W. Johnson et al. on May 23, 1989.

U.S. Pat. No. 312,278, issued to Marc L. Moor on Nov. 20,1990, discloses a binder cover having a cover panel of less than full width. This partial cover panel wraps around the binder cover when the latter is folded.

Another binder cover having a partial cover panel is seen in U.S. Pat. No. 4,838,724, issued to Meredith Spence, Jr. on Jun. 13, 1989. This partial cover panel folds inside the cover.

U.S. Pat. No. 2,791,040, issued to Salvatore L. Santorelli on May 7, 1957, and U.S. Pat. No. 5,114,009, issued to Ronald C. Johnston on May 19, 1992, disclose album-like arrangements of transparent pockets, specifically directed to displaying maps.

None of the above inventions and patents, taken either singly or in combination, is seen to describe the instant invention as claimed.

SUMMARY OF THE INVENTION

The present invention is directed to assisting those who must undertake frequent, short term itineraries, who must consult a map periodically during the itinerary, and who must take notes relating to an individual stop during the itinerary. In particular, it is directed to assisting those who, by reason of their vocations or avocations, perform repeated itineraries, organization thereof starting anew with each trip.

Examples of such itineraries include real estate agents, shoppers, sales representatives, and yard sale frequenters. In such undertakings, it is frequently the case that the itinerary cannot be planned long in advance. Also, comparison of facts may be gathered at each stop, for arriving at a conclusion regarding the best of several choices.

A real estate agent, whether showing possible selections to a potential purchaser, or compiling a list for future submission to the purchaser, may wish to stop at each property and assess the same, subsequently narrowing or prioritizing the choices. In order to accomplish this, it is desirable to display the choices geographically in visual form, as on a local street map. This enables an efficient route or circuit to be followed on an ad hoc basis. Important observations gleaned from each visit are compiled on a pad, and the priorities may be established upon contemplation of the observations.

Sales representatives visiting a series of potential customers frequently encounter the same need for organizing the itinerary, and may be required to record sales, requests for further information, or still other data central to their occupation. Shoppers may wish to follow an efficient circuit to accomplish shopping and other tasks, and record information relating to prices, selection, quality, and other pertinent data. A yard sale enthusiast, not knowing what will be offered at each location, may wish to peruse the day's offerings, and record details pertaining thereto, and return to make acquisitions after prioritizing the selections.

It is particularly useful to have the exact required materials at hand, readily accessible and readily removably supported on the portfolio. These materials will preferably include a writing implement which is easily erased, so that fresh notes are quickly entered when desired.

It will further be appreciated that the present invention is intended for use in a motor vehicle. Even when two people are engaged in the itinerary, one driving and one referring to the novel itinerary planner, it will be desirable that the apparatus occupy as little space as is feasible, and be as practical as possible to operate. This is because, firstly, space within a motor vehicle may be limited. Secondly, the second person may also be obliged to devote a certain measure of attention to observation during travel, assisting the driver, preparing for the next stop, and otherwise engaging in activities apart from employing the novel itinerary planner.

Thus, it is central to the invention that it perform its functions as conveniently and unobtrusively as possible.

To these ends, the invention comprises a folding cover or portfolio having front and rear rigid panels which can fold so as to overlie one another, a spring clip for retaining paper, and a pocket for holding a map section. As employed herein, the terms "folding cover" and "portfolio" will be used interchangeably. The portfolio includes a full width front panel, a full width rear panel, and a partial width panel or flap attached either to the front or rear panel, and which wraps around the portfolio to enable securement in the folded condition.

There is a connecting panel formed between the full width front and rear panels, to accommodate a nominal thickness of the portfolio. Writing implements are removably fastened to the inside of this connecting panel. In this location, the writing implements are protected when the portfolio is folded, yet readily accessible when the portfolio is spread open for use.

One full width panel includes a pocket for insertion therein of the cardboard backing board of a writing pad. The spring clip may be employed as a supplement, or to mark or flag a particular page of the pad. The other full width panel includes a pocket having a transparent cover, so that a map may be held and displayed therein.

A street directory is displayed on the partial width flap, so that when the portfolio is open, the writing pad, the writing implement, the map, and the directory are all exposed and accessible for use.

Writing implements, such as ink markers or grease pencils, are provided with patches of hook and loop material, which corresponds to a corresponding patch located on the inside of the cover hinge panel. The writing implement is always right at hand, and readily adhered to and removed from the novel cover.

In a similar vein, corresponding patches of hook and loop material are provided on the partial width flap and on the front cover, so that the portfolio is readily secured in the folded condition, and unfolded.

Accordingly, it is a principal object of the invention to provide a portfolio which opens to display and make accessible for use, simultaneously, a map, an index for the map, a writing pad, and writing implements.

It is another object of the invention to provide a portfolio which displays a map by covering the same with a transparent member on which writing is readily scribed and erased.

It is a further object of the invention to provide a portfolio which holds the map in a pocket, so that the map is easily inserted and withdrawn therefrom.

Still another object of the invention is to provide a portfolio which holds a writing pad by insertion of a backboard in a pocket formed in the portfolio, and which further provides a clip for grasping selected pages of the writing pad.

An additional object of the invention is to provide the portfolio with a flap of reduced width, so that the flap displays a sheet of less width than the map, and so that the flap is folded over one cover member, enabling the entire portfolio to be secured in the folded condition.

It is again an object of the invention to provide a portfolio which is as compact as is feasible.

Yet another object of the invention is to provide a portfolio holding and displaying, in its own pocket, an index corresponding to the map.

Still a further object of the invention is to provide transparent coverings for the map and index, enabling notes to be written thereon, and readily erased without permanently marking the map and index.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
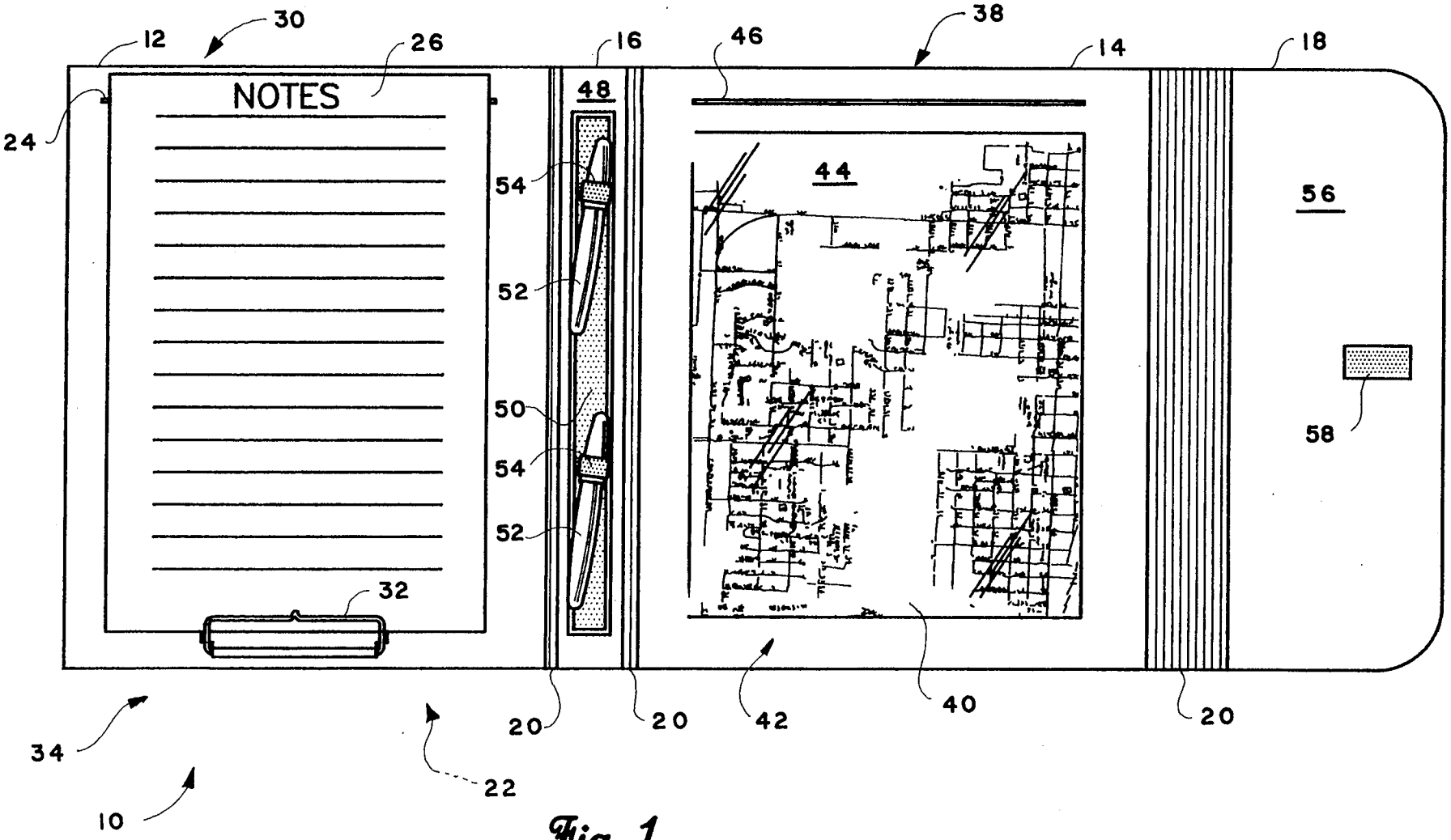
FIG. 1 is a plan view of the invention.

Turning now to FIG. 1 of the drawings, novel portfolio 10 is seen to include a front cover panel 12, a rear cover panel 14, a connecting panel 16, and a flap 18, or partial width panel foldably attached to rear cover panel 14. Joints 20 attaching adjacent panels are foldable, so that portfolio 10 may be fully opened, or folded to a closed position, as is well known in the art of portfolios, books, binders, and the like.

Front and rear cover panels 12,14 are of equal width, preferably wide enough to accommodate such standard sizes of paper as 8.5 by 11 inches (21.6 by 27.9 cm). Flap 18 is of considerably less width, for reasons which will be further explained hereinafter. Connecting panel 16 is of sufficient width to accommodate the thickness of writing materials, which will be set forth in greater detail hereinafter. A preferred width of connecting panel 16 is 1 to 1.5 inches (2.5 to 3.8 cm), this range being commonly employed in ring type binder covers.

Figure 2:
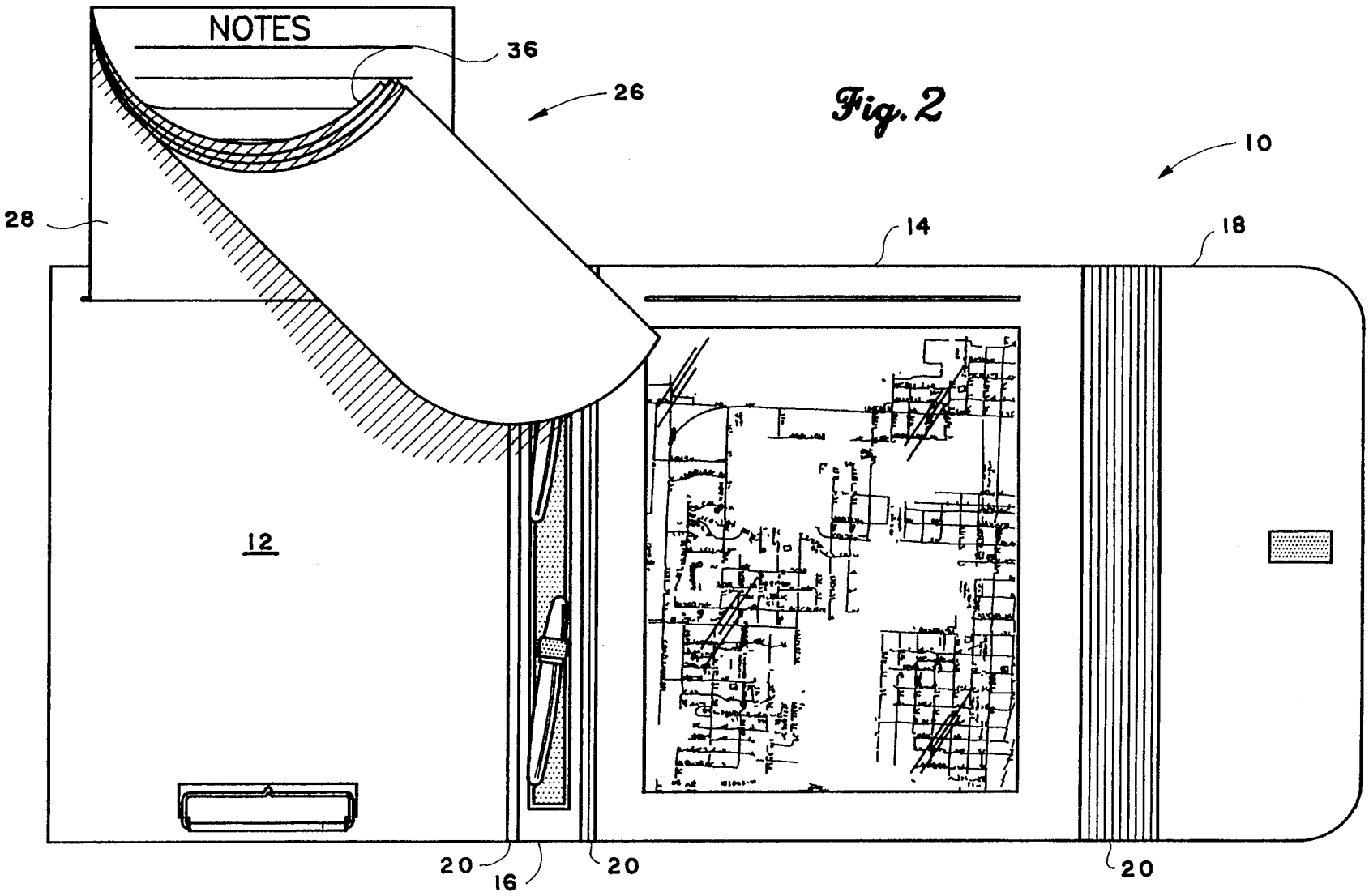
FIG. 2 is a plan view similar to FIG. 1, but showing insertion and removal of a writing pad.

Front cover panel 12 includes a pocket 22 formed therein, there being a slot 24 providing access to pocket 22. A writing pad 26 is held within pocket 22 by insertion of the stiff backboard 28 (visible in FIG. 2) of writing pad 26 into slot 24. Slot 24 is preferably formed in the top edge 30 of front cover panel 12, and a spring clip 32 is provided at the bottom edge 34 thereof. Of course, top and bottom edges 30,34 will be understood to encompass a portion of front cover panel 12, in those instances wherein it is desired to locate slot 24 and/or spring clip 32 well inside the outermost bounds of front cover panel 12. Spring clip 32 positively retains writing pad 26, which preferably comprises a stack of individual sheets 36 (see FIG. 2) adhered to backboard 28, in pocket 22.

Rear cover panel 14 has a second pocket 38, formed in much the same manner as pocket 22. A map 40 is inserted into pocket 38, and must be visible therefrom. Therefore, pocket 38, in contrast to pocket 22, includes a window 42 provided either by a sheet of transparent material 44, or as an opening. In the latter case, maps 40 placed therein must include the sheet of transparent material 44. The sheet of transparent material, such as clear polyvinyl chloride, or a similar synthetic resin, enables markings (not shown) to be made thereon. These markings, which enable important data to be recorded temporarily, superimposed over map 40, are readily erased therefrom, and leave no lasting or residual marking to map 40.

Figure 3:
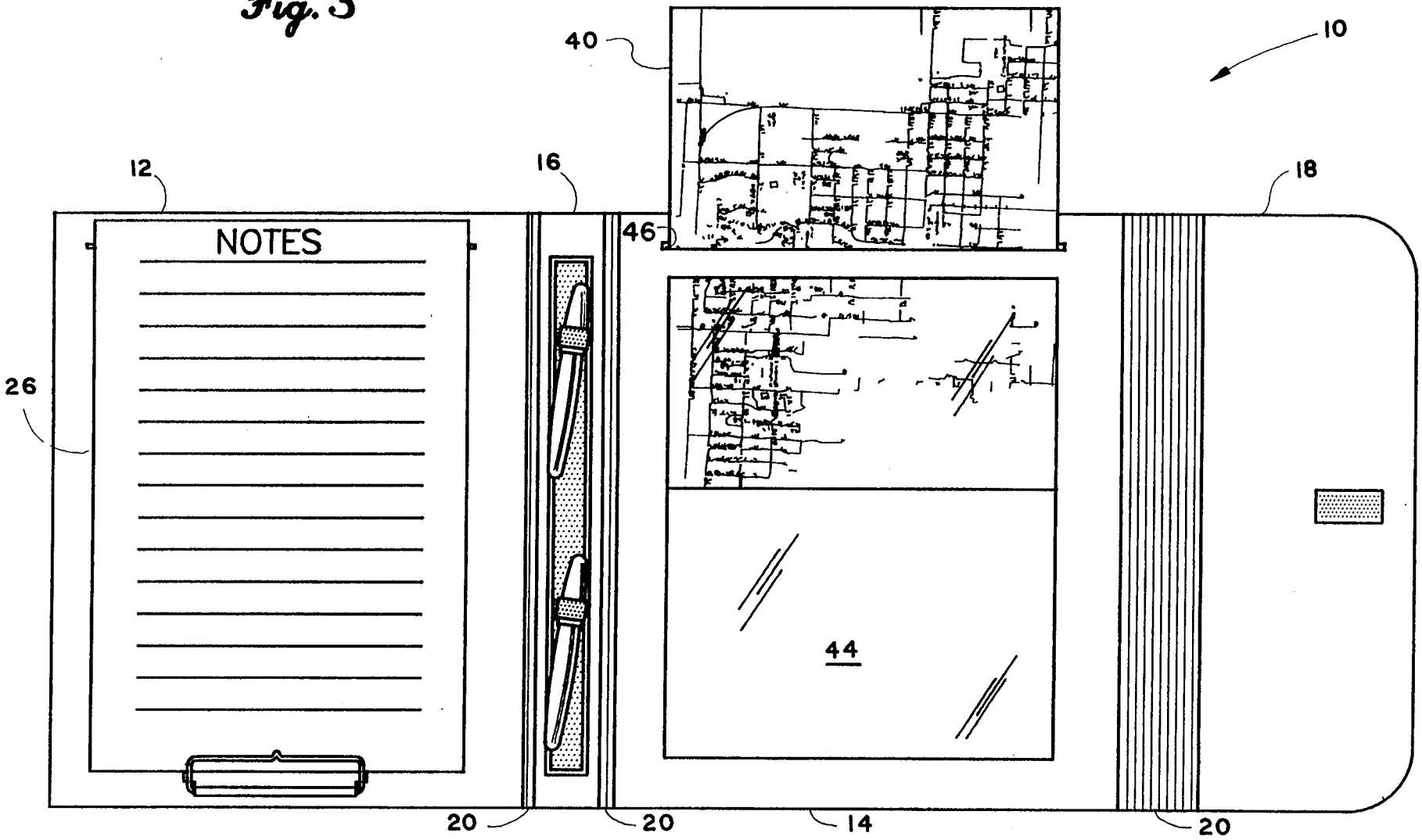
FIG. 3 is a plan view, again similar to that of FIG. 1, showing insertion and removal of a map.

Pocket 38 includes a second slot 46. Insertion or removal of map 40 from pocket 38 is best seen in FIG. 3.

Connecting panel 16 is disposed between front and rear cover panels 12 and 14, and bears, on interior surface 48, a patch of hook and loop material 50. Writing implements 52, such as ink markers or grease pencils, have a corresponding patch of hook and loop material 54, so that they are readily adhered to and removed from connecting panel 16. Writing implements 52 are selected to have any well known type of marking medium which is easily wiped from a smooth surface, as will be provided by transparent material 44. Width of connecting panel 16 is at least sufficient to accommodate thickness of writing implements 52 and writing pad 26.

Figure 4:
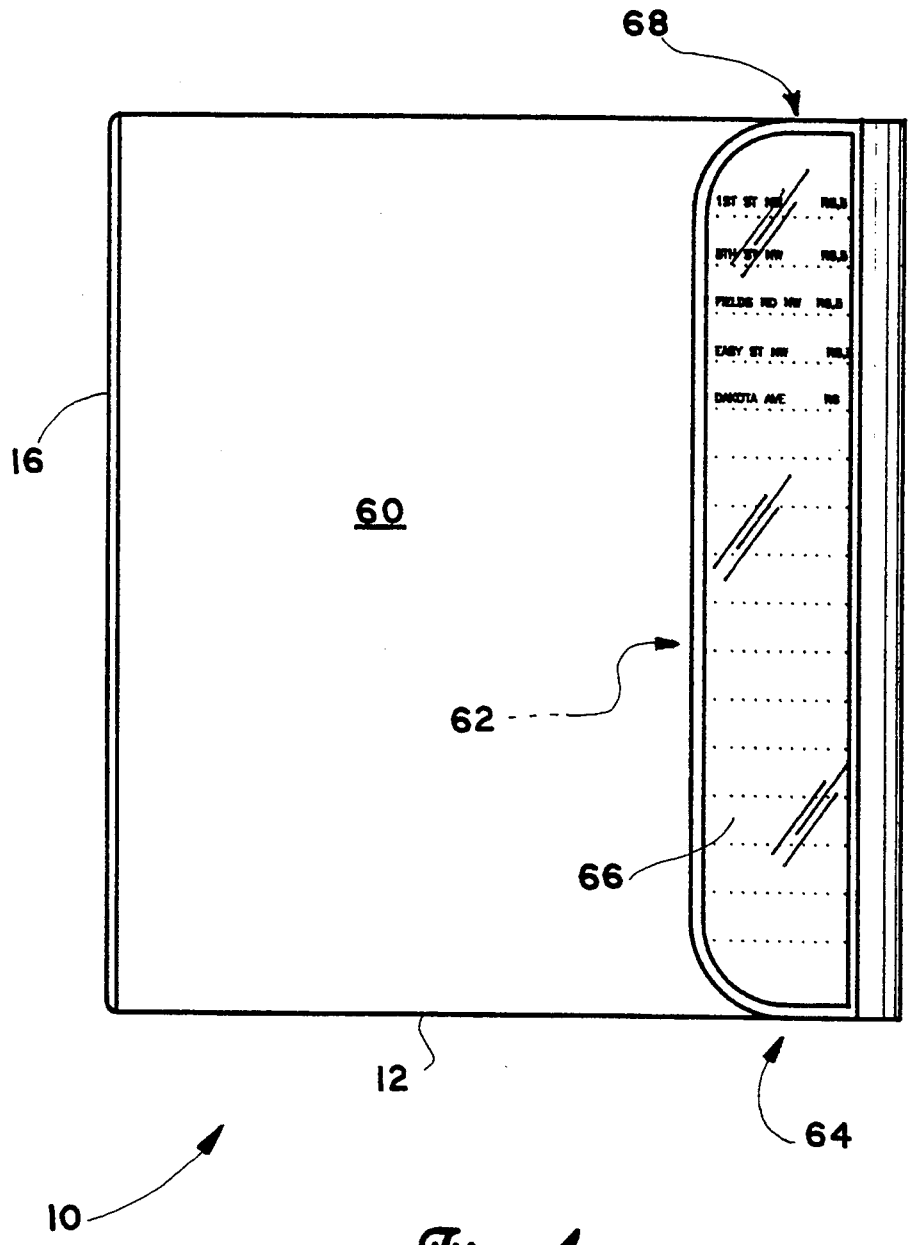
FIG. 4 is a plan view of the invention, showing the novel portfolio in the folded condition.

Flap 18 has, on its interior surface 56, another patch 58 of hook and loop material. This enables flap 18 to secure portfolio 10 in the folded condition, as illustrated in FIG. 4. Of course, the front surface 60 of front cover panel 12 has a corresponding patch 62 of hook and loop material.

Again referring to FIG. 4, flap 18 has a third pocket 64 also having a window 66, constructed in the manner of pocket 42. Useful information, such as a street directory 68, is placed in pocket 64, and is thus maintained in ready proximity to map 40 when portfolio 10 is in use. Flap 18 is of a width sufficient to partially wrap around portfolio 10 so as to enable contact between front cover panel 12 and flap 18, and also of width sufficient to accommodate street directory 68.

Thus it will be seen that a highly practical portfolio is provided with the precise combination of features which address the needs of compactness and convenience to persons riding in a motor vehicle while following an itinerary.

It is to be understood that the present invention is not limited to the embodiments described above, but encompasses any and all embodiments within the scope of the following claims.

We claim:

1. A portfolio for holding and displaying a map and writing materials, comprising:

a cover having a front panel, a rear panel, a hinge panel located between said front and rear panels, and a flap panel attached to one of said front and rear panels, one of said front and rear panels having said flap panel hingedly connected thereto and a pocket including a transparent interior face, and the other of said front and rear panels having an upper edge, a lower edge, a pocket open at one of said upper and lower edges, a pocket on said flap panel, and a spring clip attached at the other of said upper and lower edges, said hinge panel including means for releasably retaining thereto at least one writing implement, and said flap panel and said other of said front and rear panels having corresponding, aligned means for releasably adhering one to the other.

2. The portfolio according to claim 1, said pocket of said flap panel having a transparent exterior face.

3. The portfolio according to claim 1, further including a writing pad having a backboard and a plurality of sheets removably adhered thereto, said sheets having surfaces capable of retaining marking materials.

4. The portfolio according to claim 1, further including at least one writing implement including removable fastening means cooperating with said hinge panel means for releasably retaining thereto said at least one writing implement.

5. A portfolio for holding and displaying a map and writing materials, comprising:

a cover having a front panel, a rear panel, a hinge panel located between said front and rear panels, and a flap panel attached to one of said front and rear panels and having a transparent exterior face and a pocket disposed thereon, one of said front and rear panels having said flap panel hingedly connected thereto, and a pocket including a transparent interior face, and the other of said front and rear panels having an upper edge, a lower edge, a pocket open at one of said upper and lower edges, and a spring clip attached at the other of said upper and lower edges, said hinge panel including means for releasably retaining thereto at least one writing implement, and said flap panel and said other of said front and rear panels having corresponding, aligned means for releasably adhering one to the other.

6. The portfolio according to claim 5, further including a writing pad having a backboard and a plurality of sheets removably adhered thereto, said sheets having surfaces capable of retaining marking materials.

7. The portfolio according to claim 5, further including at least one writing implement, said at least one writing implement including removable fastening means cooperating with said hinge panel means for releasably retaining thereto said at least one writing implement.

8. A portfolio for holding and displaying a map and writing materials, comprising:

a cover having a front panel, a rear panel, a hinge panel located between said front and rear panels, and a flap panel attached to one of said front and rear panels, one of said front and rear panels having said flap panel hingedly connected thereto and a pocket including a first transparent interior face, and the other of said front and rear panels having an upper edge, a lower edge, a pocket open at one of said upper and lower edges, and a spring clip attached at the other of said upper and lower edges, said hinge panel including means for releasably retaining thereto at least one writing implement, said flap panel and said other of said front and rear panels having corresponding, aligned means for releasably adhering one to the other said flap panel having a pocket, and at least one writing implement including removable fastening means cooperating with said hinge panel means for releasably retaining thereto said at least one writing implement.

* * * * *